United States Patent [19]

Betsui et al.

[11] Patent Number: 4,568,561

[45] Date of Patent: Feb. 4, 1986

[54] PROCESS FOR PRODUCING ION IMPLANTED BUBBLE DEVICE

[75] Inventors: Keiichi Betsui, Kawasaki; Tsutomu Miyashita, Inagi, both of Japan

[73] Assignee: Fujitsu Limited, Kawasaki, Japan

[21] Appl. No.: 644,963

[22] Filed: Aug. 28, 1984

[30] Foreign Application Priority Data

| | | | |
|---|---|---|---|
| Aug. 30, 1983 | [JP] | Japan | 58-157068 |
| Feb. 29, 1984 | [JP] | Japan | 59-035903 |
| Feb. 29, 1984 | [JP] | Japan | 59-035904 |

[51] Int. Cl.[4] ..... B05D 3/06

[52] U.S. Cl. ..... 427/38; 204/192 N; 427/39; 365/36

[58] Field of Search ..... 427/38, 39, 130; 204/192 N; 365/36

[56] References Cited

U.S. PATENT DOCUMENTS 4,476,152 10/1984 Imura et al. ..... 427/38

*Primary Examiner*—Thurman K. Page

*Attorney, Agent, or Firm*—Staas & Halsey

[57] ABSTRACT

A process for producing an ion implanted bubble device having bubble propagation tracks formed by implanting ions in a magnetic layer formed on a substrate. The process includes: implanting ions in the magnetic layer for forming a desirable bubble propagation track thereon; exposing the ion implanted magnetic layer to plasma in order to enhance the anisotropy field change $\Delta Hk$; coating an intermediate insulation film over the magnetic layer treated with plasma; and forming bubble propagation patterns of ferromagnetic material and/or conductor patterns of conductive material on the intermediate insulation film.

5 Claims, 8 Drawing Figures

PROCESS FOR PRODUCING ION IMPLANTED BUBBLE DEVICE

BACKGROUND OF THE INVENTION (1) Field of the Invention

The present invention relates to a process for producing an ion implanted bubble device.

(2) Description of the Prior Art

An ion implanted bubble device comprises bubble propagation tracks which are formed by implanting ions of hydrogen, neon, or helium in a magnetic layer formed on a gadolinium gallium garnet (GGG) substrate by a liquid phase epitaxy process.

One of the important factors which determines the operating margins of the bubble propagation characteristic of an ion implanted bubble device is the implantation induced anisotropy field change ΔHk. The anisotropy field change ΔHk must be enhanced to obtain a high grade bubble propagation characteristic. The anisotropy field change ΔHk depends upon the type of ion and the crystal lattice strain which is induced by the ion implantation.

It is known that increasing the dose of hydrogen ions increases the ΔHk and makes it possible to obtain a very large ΔHk compared to that obtainable with helium ions or neon ions using conventional processes. Therefore, in the conventional process of producing an ion implantation bubble device, hydrogen ions are implanted to induce a large ΔHk and thus obtain a desirable stable bubble propagation characteristic.

Implantation of hydrogen ions, however, takes a very long time. On the other hand, when shortening the ion implantation time, by implanting ions other than hydrogen ions, such as neon or helium ions, a sufficiently large ΔHk is not induced.

SUMMARY OF THE INVENTION

Considering the above-mentioned problems of the prior art, it is an object of the present invention to provide a process for producing an ion implanted bubble device having a large anisotropy field change ΔHk and requiring a short ion implantation time.

According to the present invention, there is provided a process for producing an ion implanted bubble device having bubble propagation tracks formed by implanting ions in a magnetic layer formed on a substrate. The process includes implanting ions in the magnetic layer to form a desirable bubble propagation track thereon; exposing the ion implanted magnetic layer to plasma in order to enhance the anisotropy field change ΔHk; coating an intermediate insulation film over the magnetic layer treated with plasma; and forming bubble propagation patterns of ferromagnetic material or conductor patterns of conductive material on the intermediate insulation film.

BRIEF DESCRIPTION OF THE DRAWINGS

Other features of the present invention will become clear from the ensuing descriptions of the preferred embodiments made in reference to the attached drawings, wherein.

DESCRIPTION OF THE PREFERRED EMBODIMENTS

Figure 1:
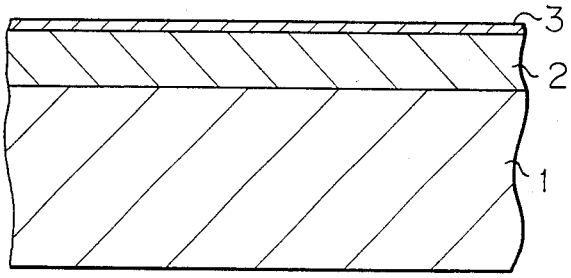
FIG. 1 is a partial sectional view of a wafer before forming bubble propagation tracks thereon.

An example of the process for producing an ion implanted bubble device in accordance with the present invention is described hereinafter with reference to the drawings. FIG. 1 is a partial sectional view of a wafer from which bubble chips are cut and divided. A magnetic garnet crystal layer (magnetic layer) 2 is formed on a GGG substrate 1 by a liquid phase epitaxy process. A thin ion implanted layer 3 is formed over the magnetic layer 2 to upgrade the magnetic characteristic of the layer 2, by, for example, implanting $Ne^+$ ions at 50 keV over the entire surface of the magnetic layer 2. However, this thin ion implanted layer 3 is not indispensable for the ion implanted bubble device.

Figure 2:
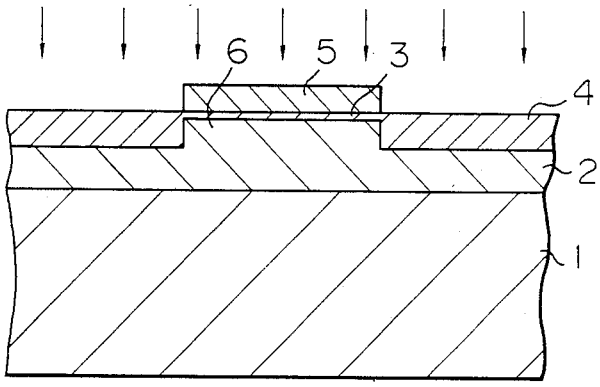
FIG. 2 is a partial sectional view of the wafer in an ion implantation step for forming bubble propagation tracks.

Next, as illustrated in FIG. 2, the magnetic layer 2 is covered by a gold mask pattern 5. Ions are implanted, as indicated by arrows, so that an ion implanted layer 4 is formed on the magnetic layer 2 and a bubble propagation track 6 is formed below the mask 5. The gold mask 5 is removed after the ion implanted layer 4 is formed.

Figure 3:
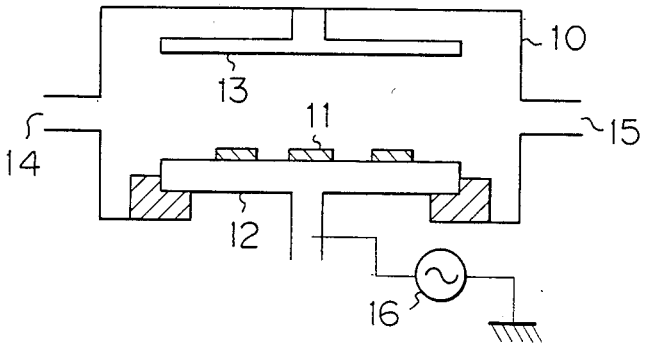
FIG. 3 is a cross sectional view of a plasma treatment device.

The ion implanted wafer is then exposed to plasma within a plasma device such as a planar-diode type dry etching system as illustrated in FIG. 3. In FIG. 3, numeral 10 is a vacuum chamber, numeral 11 is a wafer, numeral 12 is an electrode, numeral 13 is a counter electrode, numeral 14 is a gas inlet, numeral 15 is a gas outlet, and numeral 16 is a radio frequency power source. The ion implanted wafers 11 are placed on the electrode 12 in such a manner that the ion implanted layer 4 faces up. The vacuum chamber 10 is exhausted. Then, a gas, for example, a rare gas, such as helium He, neon Ne, or argon Ar, is introduced into the vacuum chamber 10 through the gas inlet 14. Power is supplied to the electrodes 12 and 13 to generate plasma therebetween. The plasma enhances the anisotropy field change ΔHk of the ion implanted layer of the wafer 11.

Figure 4:
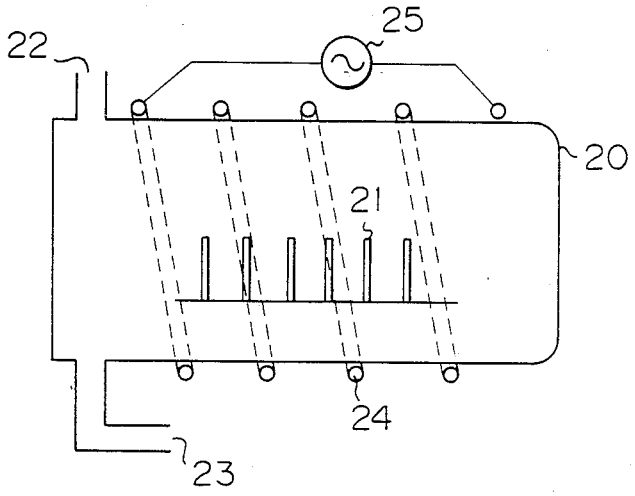
FIG. 4 is a cross sectional view of another plasma treatment device.

The plasma treatment process may also be performed within a cylinder-type plasma device as illustrated in FIG. 4, instead of within the device of FIG. 3. In FIG. 4, numeral 20 is a vacuum chamber, numeral 21 is a wafer, numeral 22 is a gas inlet, numeral 23 is a gas outlet, numeral 24 is a coil, and numeral 25 is a radio frequency power source. The ion implanted wafers 21 are disposed within the vacuum chamber 20. The chamber 20 is exhausted. Then, a gas, for example, a rare gas is introduced into the chamber 20 and power is supplied to the coil 24 to generate plasma which enhances the anisotropy field change ΔHk of the ion implanted layer of the wafer 21.

Figure 5:
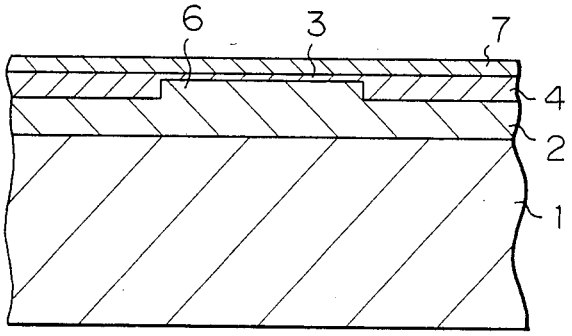
FIG. 5 is a partial sectional view of the wafer with an intermediate insulation layer coated on the magnetic layer.

After the plasma treatment, the wafer is coated with an intermediate insulation layer 7 (FIG. 5), on which further layers are formed, as described later, over the entire surface of the wafer. The insulation layer 7 is preferably $SiO_2$. However, another material, such as SiO, $Si_3N_4$, or resin, may be used as the insulation layer material. After the intermediate insulation layer 7 is coated, the wafer is annealed at 350° C. to 450° C. to stabilize the characteristics of the ion implanted layer of the wafer.

Figure 6:
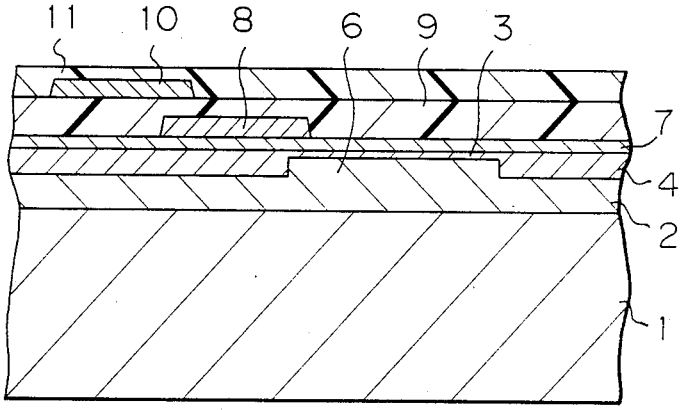
FIG. 6 is a partial sectional view of the wafer with a conductor pattern and a permalloy pattern formed on the intermediate insulation layer.

After that, as illustrated in FIG. 6, a conductor pattern 8 of gold, an insulation layer 9 of resin, a permalloy pattern 10, and an uppermost protection layer 11 are formed on the intermediate insulation layer 7 by a conventional method. The bubble propagation track 6 formed by the ion implantation constitutes, for example, a minor loop of the bubble device. The permalloy pattern 10 and the conductor pattern 8 constitute, for example, a major line and a gate disposed between the minor loop and the major line, respectively.

Experimental results concerning the ion-implantation induced anisotropy field change ΔHk are indicated in the following table, which represents the effect of the plasma treatment process in accordance with the present invention.

The experiment was performed under the following conditions.

Ion implantation:

$2\times10^{14}$ $Ne^+/cm^2$, 200 keV

Plasma treatment:

pressure 0.1 torr, wafer temp. 150° C., treatment time 20 min.

The anisotropy field change ΔHk of the wafer without conducting plasma treatment was 2,300 Oe.

| Plasma gas | ΔHk (Oe) |
|---|---|
| $H_2$ | 4,810 |
| He | 4,750 |
| Ne | 4,070 |
| Ar | 5,200 |
| He + $H_2$ | 4,750 |
| Ne + $H_2$ | 4,070 |
| Ar + $H_2$ | 5,200 |
| $O_2$ | 2,250 |
| $CF_4$ | 2,250 |

It can be seen from the table that ΔHk increases to about twice that of the wafer before plasma treatment when the wafer is treated by plasma of hydrogen gas, a rare gas (He, Ne, Ar), or a mixture of hydrogen gas and a rare gas. However, $O_2$ gas and $CF_4$ gas, which are usually used in a plasma etching treatment, decrease ΔHk.

Figure 7:
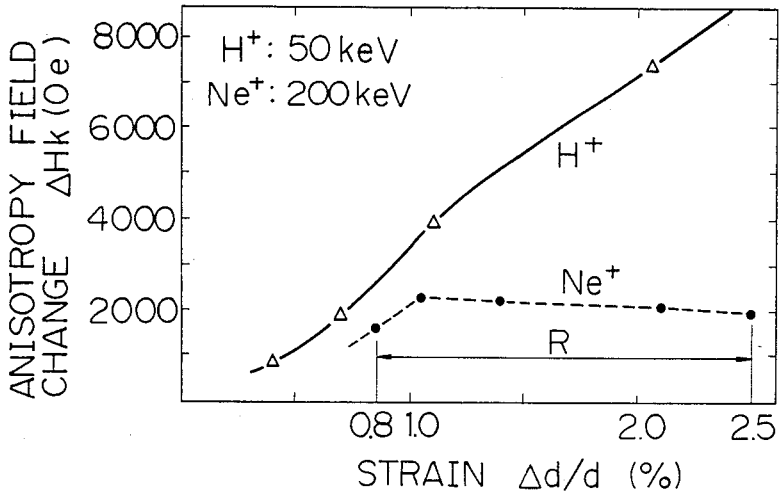
FIG. 7 is a graph representing the anisotropy field change of the ion implanted wafer before plasma treatment.

The ion material used in the ion implantation process will now be considered. FIG. 7 is a graph of experimental results of ΔHk of the wafer after the ion implantation and before the plasma treatment. The graph represents ΔHk in relation to the crystal lattice strain (ion-implantation induced lattice strain) and Δd/d in the condition that $H^+$ ions (50 keV) or $Ne^+$ ions (200 KeV) are implanted in a bubble crystal of $(YSmLuCa)_3(GeFe)_5O_{12}$ having 1.1 μm thickness and 1.1 μm stripe width. The strain Δd/d is approximately proportional to the ion implantation amount (dose amount). As can be seen from the graph, when $H^+$ ions are implanted, ΔHk increases along with the increase of Δd/d, so that a high ΔHk can be obtained, while when $Ne^+$ ions are implanted, the ΔHk is saturated at a Δd/d of about 1% and does not increase further, the value of ΔHk being low compared with the case of $H^+$ ion implantation. However, $H^+$ ion implantation takes a long time, as mentioned before. The present invention makes it possible to obtain a high ΔHk without using $H^+$ ions, therefore shortening the treatment time. In accordance with the present invention, first, ions other than $H^+$ ions, such as $Ne^+$ ions or $He^+$ ions, are implanted to an extent such that Δd/d is 0.8% to 2.5%, which is represented by the range R in FIG. 7. Second, the ion implanted crystal is exposed to plasma of $H_2$ gas, rare gas such as Ne, He, or Ar, or a mixture of $H_2$ gas and a rare gas, to enhance ΔHk.

Figure 8:
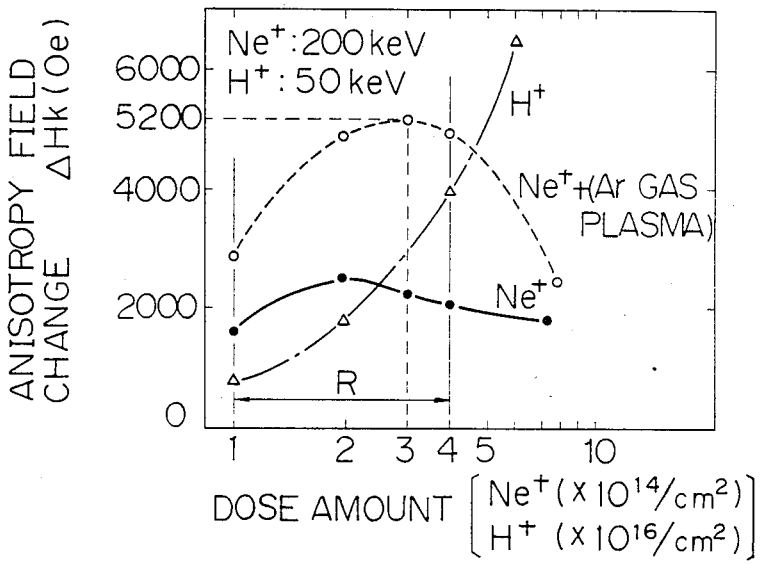
FIG. 8 is a graph representing the anisotropy field change of the wafer after plasma treatment.

FIG. 8 is a graph indicating the effect of the present invention and representing ΔHk in relation to the ion dose amount in the case of $H^+$ ion or $Ne^+$ ion implantation without plasma treatment and the case of $Ne^+$ ion implantation with subsequent plasma treatment of argon gas. $H^+$ ions were implanted at 50 keV and $Ne^+$ ions were implanted at 200 keV. The argon gas plasma treatment was performed by the plasma device of FIG. 3 under the condition of 150 mTorr vacuum pressure, 13.56 MHz discharge frequency, and 350° C. wafer temperature. In the graph of FIG. 8, the dose amount of between $1\times10^{14}$ and $4\times10^{14}/cm^2$ corresponds to the range R of strain between 0.8% to 2.5% of FIG. 7. As can be seen from FIG. 8, ΔHk of the wafer being treated with $Ne^+$ ion implantation and argon gas plasma in accordance with the present invention (short dashed line) is higher than that of the wafer being treated only with $Ne^+$ ion implantation (solid line), in the range of dose amount between $1\times10^{14}$ and $8\times10^{14}/cm^2$. ΔHk is especially enhanced in the range of dose amount between $2\times10^{14}$ and $4\times10^{14}/cm^2$, in accordance with the present invention.

FIG. 8 shows the effect of the present invention in which Ne is used as the ion material and argon gas is used as the plasma gas. However, a similar effect can be obtained if an ion material other than hydrogen is implanted, instead of $Ne^+$ ions, within the range of the ion implantation induced strain Δd/d of 0.8% to 2.5% and subsequent plasma treatment is performed in accordance with the present invention.

We claim:

1. A process for producing an ion implanted bubble device having bubble propagation tracks formed by implanting ions in magnetic layer formed on a substrate, comprising the steps of:

(a) implanting ions in said magnetic layer to form a bubble propagation track thereon;

(b) exposing said magnetic layer to plasma after step (a) to enhance ion-implantation induced anisotropy field change;

(c) coating an intermediate insulation film over said magnetic layer after step (b); and (d) forming at least one of bubble propagation patterns of ferromagnetic material and conductor patterns of conductive material on said intermediate insulation film.

2. A process according to claim 1, wherein step (b) comprises performing plasma treatment using a rare gas.

3. A process according to claim 1, wherein step (b) comprises performing plasma treatment using hydrogen gas.

4. A process according to claim 1, wherein step (b) comprises performing plasma treatment using a mixture of hydrogen gas and

5. A process according to claim 1, wherein step (a) comprises implanting an ion material other than hydrogen ions to cause ion-implantation induced lattice strain of 0.8% to 2.5%.

* * * * *

UNITED STATES PATENT AND TRADEMARK OFFICE

CERTIFICATE OF CORRECTION

PATENT NO. : 4,568,561

DATED : February 4, 1986

INVENTOR(S) : Betsui et al.

It is certified that error appears in the above-identified patent and that said Letters Patent is hereby corrected as shown below:

Col. 4, line 63, after "and" insert --a rare gas.--.

Signed and Sealed this

*Eighth* Day of *July 1986*

[SEAL]

*Attest:*

DONALD J. QUIGG

*Attesting Officer*

*Commissioner of Patents and Trademarks*